United States Patent [19]

Kusaba et al.

[11] Patent Number: 4,669,293

[45] Date of Patent: Jun. 2, 1987

[54] CONTINUOUS ROLLING METHOD AND CONTINUOUS ROLLING MILL

[75] Inventors: Yoshiaki Kusaba, Kobe; Chihiro Hayashi, Takarazuka, both of Japan

[73] Assignee: Sumitomo Metal Industries, Ltd., Osaka, Japan

[21] Appl. No.: 771,891

[22] Filed: Sep. 3, 1985

[30] Foreign Application Priority Data

Jun. 4, 1985 [JP] Japan ..... 60-121081

[51] Int. Cl.[4] ..... B21B 13/12; B21B 37/02

[52] U.S. Cl. ..... 72/235; 72/16

[58] Field of Search ..... 72/235, 16, 234, 249

[56] References Cited

U.S. PATENT DOCUMENTS 4,394,822 7/1983 Simons ..... 72/235

FOREIGN PATENT DOCUMENTS 187203 11/1983 Japan .

*Primary Examiner*—Robert L. Spruill
*Assistant Examiner*—Steve Katz
*Attorney, Agent, or Firm*—Burns, Doane, Swecker & Mathis

[57] ABSTRACT

A continuous rolling mill is constructed by arranging driven horizontal rolling mills and undriven vertical rolling mills alternately and determining the values of the thickness of the rolled material between adjacent stands, the interaxial distance between work rolls, and the diameter of the work roll to satisfy predetermined relationships.

3 Claims, 8 Drawing Figures

CONTINUOUS ROLLING METHOD AND CONTINUOUS ROLLING MILL

BACKGROUND OF THE INVENTION

The present invention relates to a continuous rolling method for rolling blooms of steel or non-ferrous metal into billets as materials for various products or rolling said billets into various products and a continuous rolling mill for practicing the method.

Heretofore, continuous-cast blooms are normally used in rolling, for example, bar steel. In a blooming mill, a continuous-cast bloom is rolled into billets, reheated, and thereafter rolled and formed into various products in a steel bar mill or wire rod mill.

The rolling mill used heretofore in a blooming mill is normally a continuous rolling mill in which horizontal mills and vertical mills are arranged alternately. In this arrangement, both the horizontal and the vertical mills are driven both in the steel bar mills and the wire rod mills.

The term "horizontal mill" as used in the specification and claims is to be understood to mean a rolling mill of the type having a pair of work rolls disposed in parallel in the direction of the width of the rolled material to hold the rolled material between them from both sides and thereby reduce the rolled material in the thicknesswise direction. The term "vertical mill" as used herein and in the claims is to be understood to mean a rolling mill of the type having a pair of work rolls disposed vertically to the surface of the rolled material to hold the longitudinal edges of the rolled material between them and thereby reduce the rolled material in the widthwise direction. The expression "a rolling mill is driven" as used herein is to be understood to mean that the work rolls mentioned above are driven to rotate.

A vertical mill requires three times or more equipment cost than a horizontal mill of the same power because a work roll driving device is located in the upper portion of the mill housing. For the same reason, the vertical mill is more than five meters in height and, accordingly, the mill house is inevitably higher and longer. Therefore, vertical mills require much more costs than horizontal mills both in equipment proper and in building of their housings.

In order to overcome this disadvantage, the present applicant has proposed in Japanese Patent Public Disclosure No. 187203/83 Official Gazette (Patent Application No. 70208/82) the technical idea of making vertical mills undriven in a continuous rolling mill having horizontal mills and vertical mills arranged alternately. However, the technical idea of merely making the vertical mills undriven is not sufficient because the rolled material would buckle between the driven horizontal mills and downstream undriven vertical mills which makes continued rolling operation difficult. For this reason, the reduction of area in an undriven vertical mill is predetermined to be 66% or lower that of a driven horizontal mill on the upstream side. In such arrangement, the total quantity of thickness reduction by the horizontal mills becomes nearly twice the total quantity of width reduction by the vertical mills. Therefore, when a billet or product of square section is required, a material of rectangular section having a large flatness must be used because a material of square section cannot be used in a continuous rolling mill as described above.

On the other hand, requirements for the quality of materials for bar steel are very strict. In particular, decreasing both non-metallic inclusions and central segregation is important. Rolling of materials such as slabs is not allowed because it leads to increasing central segregation. Blooms widely used have generally sectional sizes from thickness 300 mm×width 300 mm to thickness 300 mm×width 400 mm. The technical art disclosed in the above-mentioned patent application is difficult to be applied to such blooms of square or nearly square sections.

SUMMARY OF THE INVENTION

An object of the present invention is to provide a continuous rolling mill having horizontal mills and vertical mills disposed alternately, in which the substantially equal reduction of area is obtained by both the undriven vertical mills and the driven horizontal mills.

A continuous rolling mill according to the present invention comprises $2n+1$ stands (n is an integer equal to or larger than unity) having horizontal mills and vertical mills disposed alternately. A horizontal mill having a pair of driven horizontal work rolls is disposed at each of odd-numbered stands including the first stand and the last stand. A vertical mill having a pair of undriven vertical work rolls is disposed at each of even-numbered stands including the second stand. The stands are arranged so as to satisfy the following conditions:

$$0.1 < di/Di < 0.4 \quad (1)$$

$$Li/Di < 4.0 \quad (2)$$

where, di: thickness of rolled material between adjacent stands

Li: interaxial distance of work rolls i: 1, 2, 3, . . . n

Di: outer diameter of work rolls of horizontal mills.

In another aspect of the present invention, the continuous rolling mill described above may have ordinary rolling mills disposed on the downstream side thereof.

In the continuous rolling method according to the present invention using the continuous rolling mill comprising horizontal and vertical mills disposed alternately with or without ordinary rolling mills added thereto, a material can be rolled in a single pass or in reversing passes with rotation of it by 90° about the rolling direction of it.

In the continuous rolling mill according to the present invention having undriven vertical mills, in order to obtain the same reduction effect as by the continuous rolling mill having driven vertical mills, the distance Li between the axis of the roll of the driven horizontal mill by which the rolled material is pushed and the axis of the roll of the undriven vertical mill into which the rolled material is pushed, and the thickness di of the material between them are predetermined in the ranges defined by said formulae (1) and (2). With the values of Li and di in these ranges, the undriven vertical mill provides the reduction of area equivalent to or better than the driven horizontal mills without buckling caused in the material.

After the rolled material has been released from the driven horizontal mill by which the material was pushed, the material is pulled out of the undriven vertical mill by the driven horizontal mill disposed on the downstream side of said undriven vertical mill. In this case, a tensile force is exerted to the rolled material and the results of the rolling is dependent upon the presence of slip in the driven horizontal mill.

The slip can be easily prevented by increasing the area of contact between the work rolls and the rolled material and roughening the surface of the rolls, to thereby increase the coefficient of friction between the rolls and the rolled material. Particularly, the slip prevention effect is increased simply by using a box groove to restrain the edges of the rolled material.

BRIEF DESCRIPTION OF THE DRAWINGS

The invention will be better understood from the following description taken in connection with the accompanying drawings in which.

DETAILED DESCRIPTION OF THE PREFERRED EMBODIMENTS

Figure 1:
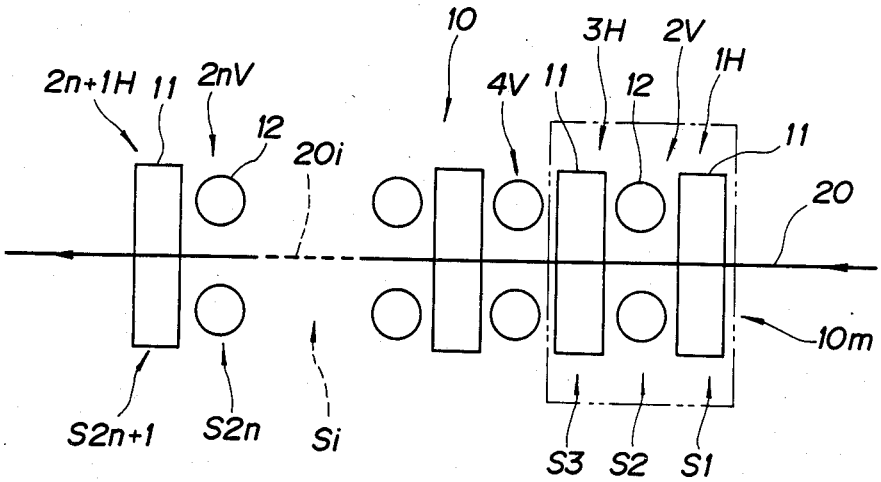
FIG. 1 is a plan view illustrative of the schematic arrangement of a continuous rolling mill according to the present invention.

Certain preferred embodiments and examples of the present invention will now be described in detail with reference to the drawings, in which FIG. 1 is a plan view illustrative of a schematic arrangement of a continuous rolling mill 10 according to the present invention. A rolled material 20 runs from right to left in FIG. 1. Stands of the continuous rolling mill 10 are numbered first, second, . . . ith . . . 2nth, and (2n+1)th from the upstream toward the downstream in the rolling direction and denoted by $S_1$, $S_2$ . . . $S_i$ . . . $S_{2n}$, and $S_{2n+1}$, respectively.

Horizontal mills 1H, 3H, . . . (2i−1)H . . . (2n+1)H each compising a pair of driven horizontal work rolls 11 are disposed at the odd-numbered stands $S_{(2i-1)}$ (i=1, 2, 3 . . . n+1) including the first stand $S_1$ and the last stand $S_{2n+1}$, respectively.

Vertical mills 2V, 4V, . . . **2*i*V . . . 2*n*V each comprising a pair of undriven vertical work rolls 12** are disposed at the even-numbered stands $S_{2i}$ (i=1, 2, . . . n) including the second stand $S_2$, respectively.

Among the continuous rolling mills 10 according to the present invention, a mill comprising a smallest number of stands includes rolling mills 1H, 2V and 3H, and is hereafter called the smallest unit continuous rolling mill **10*m***.

A rolled material portion **20*i* between the (2i−1)th stand ($S_{2i-1}$) and the (2i)th stand $S_{2i}$ (i=1, 2, . . . n), that is between two adjacent stands had the thickness di, and the interaxial distance between the work rolls 11 and 12** of said adjacent stands is denoted by Li. The diameter of the horizontal roll of the horizontal mill of the (2i−1) stand ($S_{2i-1}$) is denoted by Di.

Figure 2:
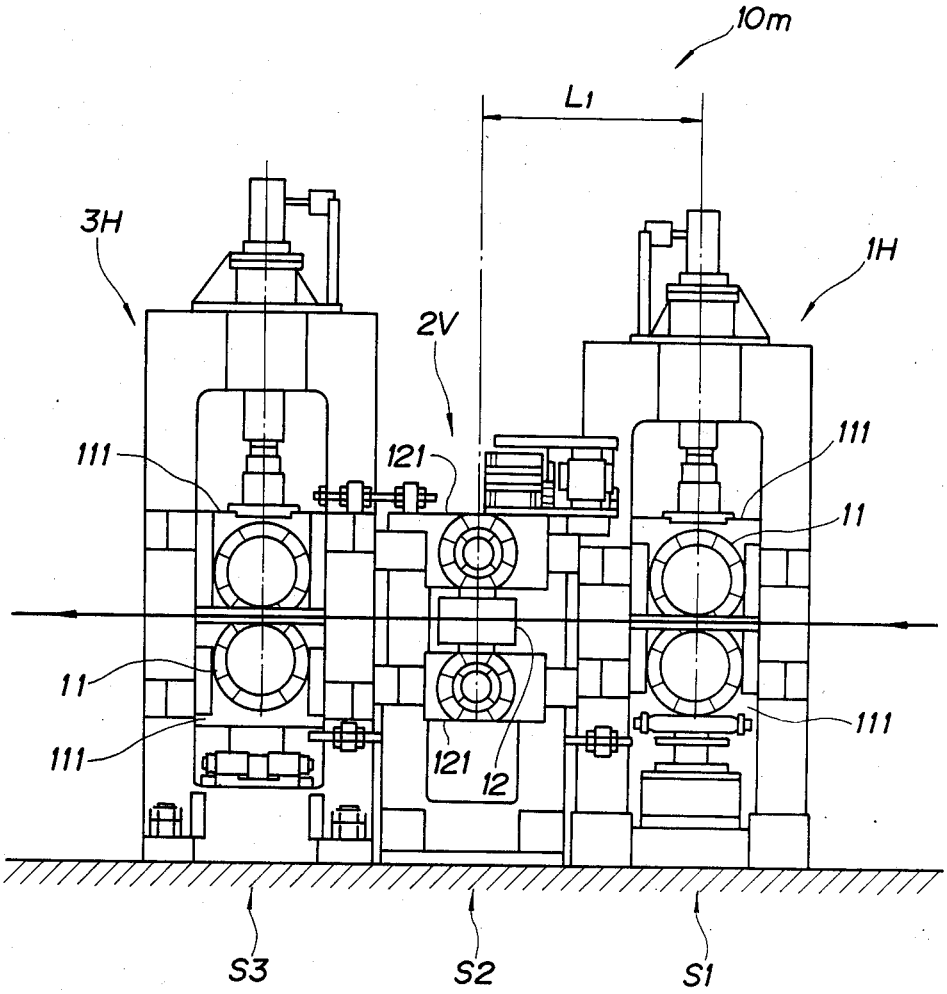
FIG. 2 is a side view of a smallest unit continuous rolling mill according to the present invention.

FIG. 2 is a side view of the smallest unit continuous rolling mill **10*m* according to the present invention, in which the undriven vertical rolling mill 2V is disposed between the driven horizontal mills 1H and 3H, and these mills 2V, 1H and 3H are fixed closely in mutual connection with each other. The horizontal work rolls 11 and the vertical work rolls 12 are supported by roll chocks 111 and 121** of the mills, respectively.

In the continuous rolling mill according to the present invention, as mentioned above, the values of the thickness di of the rolled material portion between two adjacent stands, the interaxial distance Li of the rolls, and the outer diameter Di of the roll are limited so as to be within the range of condition defined by the formulae (1) and (2) for the reason to be described hereunder.

Result of the rolling by pushing depends upon buckling of the material and presence of slip in the horizontal rolls. In the first place, the buckling stress at which buckling occurs in the material is inversely proportional to the square of the interaxial distance Li of the rolls and is proportional to the first power of the thickness di of the material. On the other hand, the stress occurred in the material when pushed is for rolling the material by the idle vertical mill and increases substantially in proportion to the reduction of area by the vertical mill.

Therefore, a large reduction of area is made possible in the undriven vertical mill when the interaxial distance Li of the rolls of the driven horizontal mill and the undriven vertical mill is as small as possible and the thickness of the material released from the horizontal mill is as large as possible.

The interaxial distance Li of the rolls is smallest in the case where the rolls of the horizontal and the vertical mills are in contact with each other. In order to obtain the same reduction of area in the horizontal and the vertical mills under this condition, the thickness di of the material must be equal to or larger than 0.1 times the diameter Di of the roll. On the other hand, when the thickness of the material is equal to or larger than 0.4 times the diameter Di of the roll, biting of the material in the horizontal mill is insufficient. Accordingly, when the thickness di of the material released from the horizontal mill is 0.4 times the roll diameter, the interaxial distance Li of the rolls of the horizontal and the vertical mills must be equal to or smaller than four times the roll diameter in order to obtain the same reduction of area by the horizontal and the vertical mills.

For the reason described above, the conditions required to obtain the same reduction of area by the horizontal and the vertical mills are:

$$0.1 < di/Di < 0.4$$

$$Li/Di < 4.0$$

The continuous rolling mill according to the present invention can be used for various purposed such as blooming, steel bar, wire rod, hot rolling and so forth. Further, in the continuous rolling mill according to the present invention, when required, a material may be rolled in a single pass or in reversing passes or turned by 90° about the rolling direction. The continuous rolling mill according to the present invention can include a conventional continuous rolling mill disposed on the downstream side thereof.

An example of improvement in reduction of area by the continuous rolling mill according to the present invention will now be described.

In this example, rolling operation was carried out under the conditions: horizontal and vertical work roll diameter Di=300 mm, thickness of rolled material on exit side of horizontal mill di=45–105 mm (di/Di=0.15–0.35), interaxial distance between horizontal and vertical work rolls Li=1300 mm, 715 mm (Li/Di=4.33, 2.38), rolling temperature 1100° C., and low carbon killed steel used as the material. The relationship between the reduction of area by the driven mills and the reduction of area by the undriven mills in this example is shown in FIGS. 3 and 4, in which FIG. 3 shows the results of the case using a prior art continuous rolling mill in which vertical mills are undriven and FIG. 4 shows the results of the case using the continuous rolling mill according to the present invention.

Figure 3:
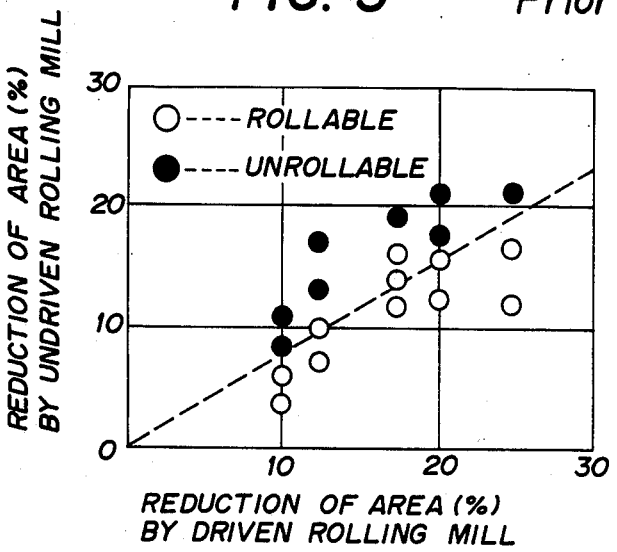
FIG. 3 Prior Art
FIG. 3 is a graph illustrative of the relationship of reduction of area of driven and undriven rolling mills in a prior art continuous rolling mill.
Figure 4:
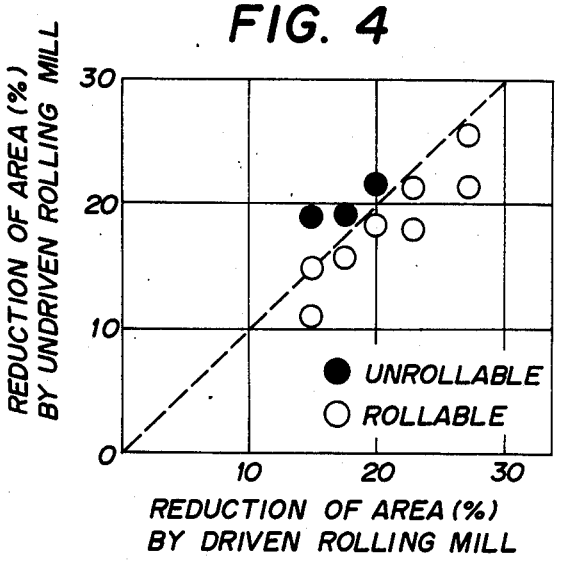
FIG. 4 is a graph illustrative of the relationship of reduction of area of driven and undriven rolling mills in a continuous rolling mill according to the present invention.
Figure 6:
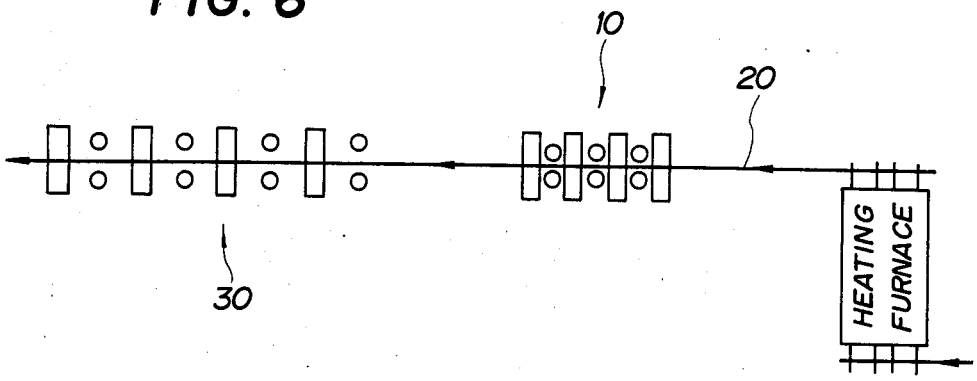
FIG. 6 is a plan view illustrative of an example of application of the continuous rolling mill according to the present invention to steel Bar Mills.

In the case of the prior art rolling mill of Li=1300 mm (Li/Di=4.33), the reduction of area by the vertical mill is approximately 70% of the reduction of area by the horizontal mill as shown in FIG. 3. On the other hand, in the case of the rolling according to the present invention of Li=715 mm (Li/Di=2.38) can be as high as 100% as shown in FIG. 4.

The continuous rolling method according to the present invention will now be described in detail with reference to certain examples of practice thereof.

EXAMPLE OF APPLICATION TO BLOOMING MILLS

Figure 5:
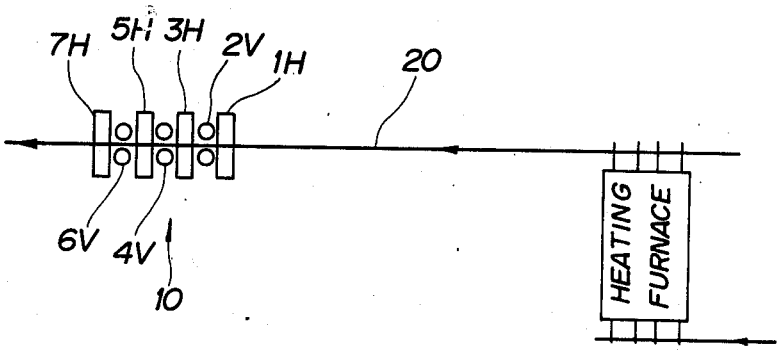
FIG. 5 is a plan view illustrative of an example of application of the continuous rolling mill according to the present invention to Blooming Mills.

Rolling was carried out using the continuous rolling mill 10 shown in FIG. 5 having the arrangement described below and under the conditions described below:

Number of stands: seven

1st, 3rd, 5th and 7th stands $S_1$, $S_3$, $S_5$, and $S_7$ were driven horizontal mills (1H, 3H, 5H and 7H)

2nd, 4th and 6th dtands $S_2$, $S_4$ and $S_6$ were undriven vertical mills (2V, 4V and 6V).

Interaxial distance Li between the work rolls: 1.4 m

Overall length of the continuous rolling mill: 8.4 m

Outer diameter Di of a horizontal or vertical roll: 900 mm

Thickness di of the rolled material between adjacent stands: 340–220 mm

Bloom (starting material): thickness 400 mm×width 300 mm

Billet (product): thickness 180 mm×width 180 mm

Pass schedule: shown in Table 1.

TABLE 1

| Stand No. | Rolling Mill | Rolled Material Thickness 400 mm | Rolled Material Width 300 mm | Area of Cross Section ($cm^2$) 1200 | Reduction of Area (%) | V/H Ratio |
|---|---|---|---|---|---|---|
| 1 | Horizontal Driven | 340 | 305 | 1037 | 13.6 | 0.83 |
| 2 | Vertical Undriven | 347 | 265 | 920 | 11.3 | |
| 3 | Horizontal Driven | 275 | 270 | 739 | 19.7 | 0.86 |
| 4 | Vertical Undriven | 286 | 215 | 613 | 17.1 | |
| 5 | Horizontal Driven | 222 | 222 | 492 | 19.8 | 0.89 |
| 6 | Vertical Undriven | 230 | 176 | 404 | 17.8 | |
| 7 | Horizontal Driven | 180 | 180 | 324 | 19.8 | |

For comparison, construction and rolling results of the prior art continuous rolling mill are described below. Those not specifically described below were the same as those described above.

Li: 5.0 m

Overall length of the continuous rolling mill: 30 m

Billet (product): thickness 180 mm×width 220 mm

Pass schedule: shown in Table 2.

TABLE 2

| Stand No. | Rolling Mill | Rolled Material Thickness 400 mm | Rolled Material Width 300 mm | Area of Cross Section ($cm^2$) 1200 | Reduction of Area (%) | V/H Ratio |
|---|---|---|---|---|---|---|
| 1 | Horizontal Driven | 340 | 305 | 1037 | 13.6 | 0.60 |
| 2 | Vertical Undriven | 345 | 276 | 952 | 8.2 | |
| 3 | Horizontal Driven | 275 | 281 | 779 | 18.2 | 0.62 |
| 4 | Vertical Undriven | 281 | 244 | 692 | 11.2 | |
| 5 | Horizontal Driven | 222 | 250 | 560 | 19.1 | 0.60 |
| 6 | Vertical Undriven | 228 | 215 | 490 | 11.4 | |
| 7 | Horizontal Driven | 180 | 220 | 396 | 19.2 | |

EXAMPLE OF APPLICATION TO STEEL BAR MILLS

Rolling of steel bar was carried out in an arrangement in which the continuous rolling mill 10 according to the present invention was disposed as a roughing tandem mill upstream of a conventional intermediate tandem mill 30, under the following conditions:

Number of stands: seven

1st, 3rd, 5th and 7th stands $S_1$, $S_3$, $S_5$ and $S_7$ were driven horizontal mills 2nd, 4th and 6th stands $S_2$, $S_4$ and $S_6$ were undriven vertical mills Interaxial distance Li between the work rolls: 0.9 m Overall length of the continous rolling mill: 5.4 m Outer diameter Di of horizontal or vertical work roll: 550 mm Thickness di of the rolled material between adjacent stands: 140–90 mm Billet (starting material): diameter 180 mm Steel bar (product): diameter 75 mm Pass schedule: shown in Table 3.

In this example, work rolls of box groove having strong side restriction were used as horizontal rolls and work rolls of box groove having weak side restriction were used as vertical work rolls.

TABLE 3

| Stand No. | Rolling Mill | Rolled Material Thickness 180 mm | Rolled Material Width 180 mm | Area of Cross Section ($cm^2$) 324 | Reduction of Area (%) | V/H Ratio |
|---|---|---|---|---|---|---|
| 1 | Horizontal Driven | 140 | 184 | 257 | 20.5 | 0.89 |
| 2 | Vertical Undriven | 150 | 140 | 210 | 18.4 | |
| 3 | Horizontal Driven | 110 | 144 | 158 | 24.6 | 0.93 |
| 4 | Vertical Undriven | 122 | 100 | 121 | 23.0 | |
| 5 | Horizontal Driven | 90 | 104 | 93 | 23.2 | 0.961 |
| 6 | Vertical Undriven | 102 | 71 | 72 | 22.6 | |
| 7 | Horizontal Driven | 75 | 75 | 56 | 22.3 | |

For comparison, construction and rolling results of the prior art continuous rolling mill are described below.

A roughing tandem mill comprising six stands having horizontal and vertical mills arranged alternately was used.

Li: 4.5 m

Overall length of the tandem mill: 25 m

Pass schedule: shown in Table 4.

TABLE 4

| Stand No. | Rolling Mill | Rolled Material Thickness 180 mm | Rolled Material Width 180 mm | Reduction of Area (%) |
|---|---|---|---|---|
| 1 | Horizontal Driven | 145 | 130 | 24.6 |
| 2 | Vertical Driven | 125 | 200 | 22.8 |
| 3 | Horizontal Driven | 130 | 90 | 18.4 |
| 4 | Vertical Driven | 95 | 151 | 23.8 |
| 5 | Horizontal Driven | 75 | 75 | 21.3 |
| 6 | Vertical Driven | 65 | 110 | 38.9 |

EXAMPLE OF APPLICATION TO WIRE ROD MILLS

In a wire rod mills producing wire rods of 20 mm or smaller diameter from billets of 115×115 mm size, a roughing tandem mill heretofore comprised eight horizontal mills, in which a material was twisted by 90° in each pass and rolled to the size 45×45 mm at the exit thereof by diamond calibers and square calibers arranged alternately. In this case, the roll diameter was 450 mm and the interaxial distance between the horizontal and the vertical work rolls was 3.5 m.

Figure 7:
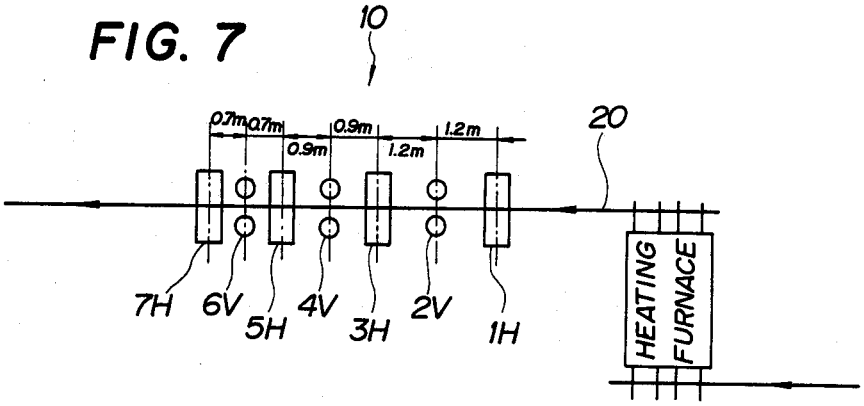
FIG. 7 is a plan view illustrative of an example of application of the continuous rolling mill according to the present invention to Wire Rod Mills.
Figure 8:
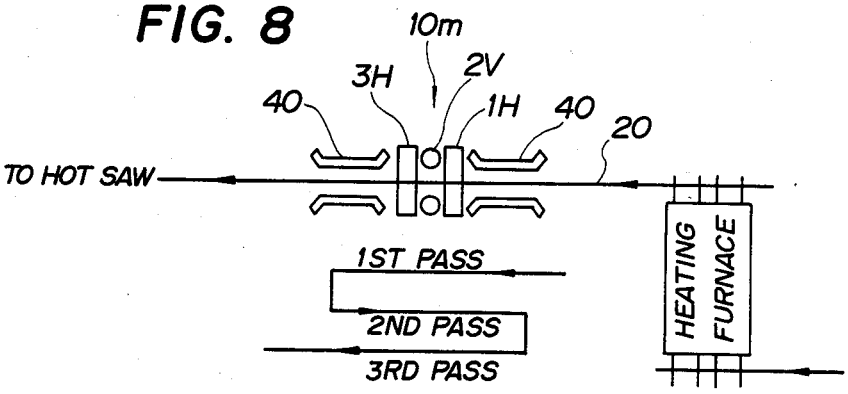
FIG. 8 is a plan view illustrative of an example of application of the continuous rolling mill according to the present invention to a Blooming Mills.

In this example of application of the continuous rolling mill 10 (FIG. 7), as shown in Table 5, diameter of the horizontal work rolls was gradually reduced from 500–400 mm and the interaxial distance of the horizontal and the vertical work rolls was gradually reduced toward the downstream side to prevent buckling of the rolled material. Since it was necessary to provide a square section to the rolled material at the exit, the caliber arrangement used was, as shown in Table 5, diamond caliber at sixth and seventh stands and square groove at the last stand.

TABLE 5

| Stand No. | Rolling Mill | Work Roll Diameter Di (mm) | Li/Di | Roll Caliber |
|---|---|---|---|---|
| 1 | Horizontal Driven | 500 | } 1.2 | diamond |
| 2 | Vertical Undriven | 500 | } (1.2) | square |
| 3 | Horizontal Driven | 450 | } 0.9 | diamond |
| 4 | Vertical Undriven | 450 | } (0.9) | square |
| 5 | Horizontal Driven | 400 | } 0.7 | diamond |
| 6 | Vertical Undriven | 400 | } (0.7) | diamond |
| 7 | Horizontal Driven | 400 | | square |

In remodeling a conventional wire rod mills having materials twisted into a works having horizontal and vertical mills arranged alternately in tandem without twisting materials, if the continuous rolling mill according to the present invention is used, the mill cost is reduced to a half or lower as compared with the conventional system with driven vertical rolls and the reconstruction of the mill houses is made unnecessary. Housing of a driven vertical mill is approximately 8 m in height that is about three times that of a horizontal mill. Accordingly, if a driven vertical mill is housed in a building of the conventional continuous horizontal mill, there is a possibility of hitting between the vertical mill and a crane and, therefore, reconstruction of the mill house becomes necessary.

While we have described and illustrated certain preferred embodiments and examples of our invention in the foregoing specification, it will be understood that these embodiments and examples are merely for the purpose of illustration and description and that various other forms may be devised or practiced within the scope of our invention, as defined in the appended claims.

What is claimed is:

1. A method for continuously rolling a bloom or billet having a substantially square cross-section into a product having a substantially square cross-section, in a continuous rolling mill comprising (2n+1) stands (n being an integer equal to or larger than unity), comprising the steps of:

arranging horizontal rolling mills and vertical rolling mills alternately;

disposing a horizontal rolling mill having a pair of driven horizontal work rolls at each of odd-numbered stands inclusive of the first and the last stands;

disposing a vertical rolling mill having a pair of undriven vertical work rolls at each of even-numbered stands inclusive of the second stand;

determining the thickness di of the rolled material between adjacent stands and the interaxial distance Li between the work rolls to satisfy the conditions defined by the following formulae:

$$0.1 < di/Di < 0.4$$

$$Li/Di < 4.0$$

where, $i = 1, 2, 3, \ldots n$

Di: outer diameter of a work roll;

passing the rolled material through said continuous rolling mill for rolling; and setting the reduction of area in said undriven vertical rolling mill to be at least 83% of that in said driven horizontal rolling mill.

2. A continuous rolling method as set forth in claim 1 characterized in that a reduction of area of 20–30% is performed on respective stands of said continuous rolling mill.

3. A continuous rolling method as set forth in claim 1 and further providing conventional rolling mills having all driven stands disposed on the downstream side of said continuous rolling mill.

* * * * *